United States Patent [19]

Reilly et al.

[11] Patent Number: 4,854,465

[45] Date of Patent: Aug. 8, 1989

[54] CONTAINER HAVING DEPRESSION FOR CONFINING SMALLER CONTAINERS

[76] Inventors: Dann M. Reilly, 523 Chinoe Rd., Lexington, Ky. 40502; Robert H. Wiedo, 1251 Harry Wise Rd., Lawrenceburg, Ky. 40342

[21] Appl. No.: 48,417

[22] Filed: Jul. 27, 1987

[51] Int. Cl.[4] ..... B65D 21/02; B65D 81/36; B65B 39/00

[52] U.S. Cl. ..... 220/23.4; 141/98; 184/106; 206/223; 220/1 C; 220/23.83

[58] Field of Search ..... 206/223, 577, 216, 499; 220/1 C, 23.83, 23.86, 23.4, 20, 23.8; 141/98; 184/106, 1.5; 215/12.1, 6

[56] References Cited

U.S. PATENT DOCUMENTS

| | | | |
|---|---|---|---|
| Re. 27,449 | 8/1972 | Bartz | 220/1 C X |
| D. 219,642 | 1/1971 | Prahs | 220/23.4 X |
| 3,048,264 | 8/1962 | Krause | 206/45.33 |
| 3,610,458 | 10/1971 | Nissky | 220/23.4 |
| 3,658,204 | 4/1972 | Bottger | 220/23.4 |
| 3,703,956 | 11/1972 | Oswalt | 206/223 |
| 3,861,565 | 1/1975 | Richmeier, Jr. | 215/12.1 X |
| 4,010,863 | 3/1977 | Ebel | 220/1 C |
| 4,098,398 | 7/1978 | Meyers | 206/223 |
| 4,195,728 | 4/1980 | Cardamone | 206/45.33 |
| 4,296,838 | 10/1981 | Cohen | 184/106 |
| 4,332,282 | 6/1982 | Strange | 141/98 X |
| 4,403,692 | 9/1983 | Pollacco | 206/223 |
| 4,533,042 | 8/1985 | Pollacco | 206/223 |
| 4,592,478 | 6/1986 | Laconis | 220/23.83 |
| 4,756,411 | 7/1988 | Garland | 206/223 |

FOREIGN PATENT DOCUMENTS

| | | | |
|---|---|---|---|
| 3032523 | 4/1982 | Fed. Rep. of Germany | 220/23.83 |

*Primary Examiner*—Stephen Marcus
*Assistant Examiner*—Bryon Gehman

[57] ABSTRACT

This invention is a container that serves as a marketing and transporting device for wholesalers and retailers of unit volume (e.g., U.S. quart) oil containers, such as high density, polyethylene (HDPE) containers being marketed by various petroleum companies. Once in the consumer's possession, this invention is used to transport oil containers from the retail outlet to the consumer's destination point where, when emptied of the individual oil containers, it becomes a crankcase oil reservoir for the receiving, containment and transportation of used oil and empty oil containers to a recycling and/or disposal point.

At this recycling or disposal point, all significant oil quantities in the container are transferred to a bulk container to be eventually recycled or disposed of in accordance with applicable regulations.

1 Claim, 1 Drawing Sheet

CONTAINER HAVING DEPRESSION FOR CONFINING SMALLER CONTAINERS

BACKGROUND OF THE INVENTION

1. Field of the Invention

This invention relates to the combined packaging and displaying of (1) quart containers of motor oil and is concerned with providing a single, disposable package that secures a desired number of quarts of oil for eventual sale, simultaneously displays these containers of oil, acts as a collection basin and sealable, transportable reservoir for used motor oil, while providing a repository for the empty oil containers left after completion of an oil change.

2. Description of the Prior Art

Due to escalating labor costs and growth of the DO-IT-YOURSELF movement, an increasing number of individuals are choosing to perform basic automotive maintenance functions rather than pay to have them done. One maintenance procedure that is performed by many vehicle owners is a crankcase oil change. Traditionally, this has involved purchasing 3 to 6 quarts of oil, transporting them in a sack to a garage, driveway or curb where old oil is drained into a dishpan or other similar vessel and replaced with new oil. Upon completion, the storage of a dishpan or similar container and the disposal of 3 to 6 quarts of used crankcase oil and empty containers must be dealt with.

This entire procedure is normally very messy in that the used oil must be transferred from the drain pan to a container usually via funnel. Spills are nearly unavoidable and all conveyance devices must be cleaned with petroleum solvents, stored dirty, or discarded.

SUMMARY OF THE INVENTION

The purpose of this invention is to provide a single device to be used in performing an oil change that, by its design, eliminates the need for multiple devices and handling procedures currently used by individuals changing crankcase oil in their vehicle or other engine. It is intended to be a "cradle to grave" invention that secures and displays containers of new, unused oil for retail sale, acts as a transporting device from the retail outlet to the consumer's desired location (in lieu of a sack or carton), acts as a drain pan/reservoir during the actual oil change (in lieu of a drain pan) and finally seals and acts as a storage, transportation or disposal device for the used oil and the empty oil containers resulting from the oil change. (In lieu of a jug or jugs of used oil, a sack or carton of quart oil containers and a dirty funnel and drain pan.)

DESCRIPTION OF THE PREFERRED EMBODIMENT

Figure 2:
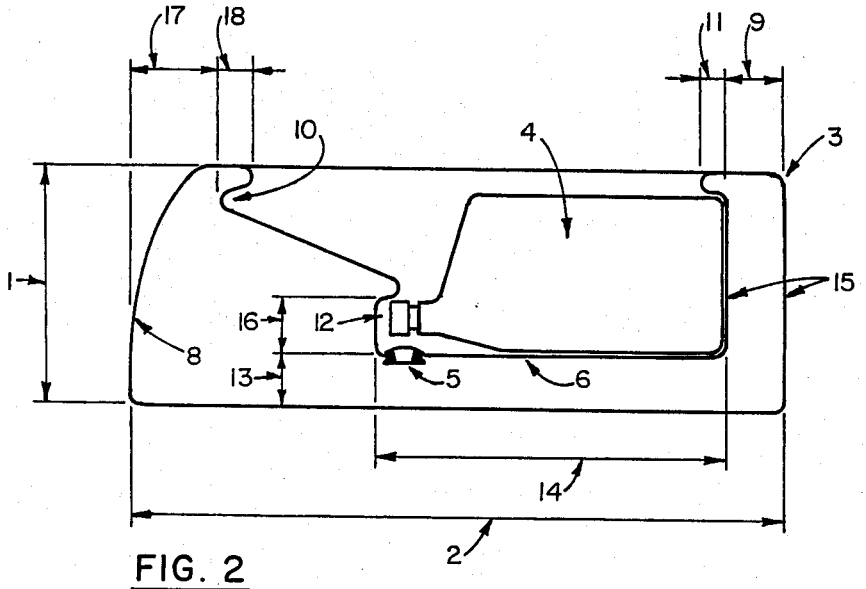
FIG. 2 is a longitudinal section at centerline and FIG. 3 is a partial section showing sidewall configuration.
Figure 3:
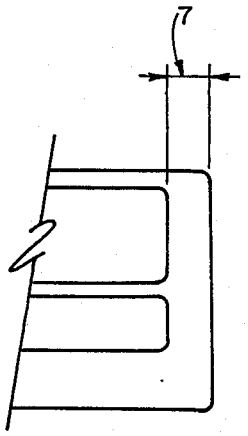
Figure 1:
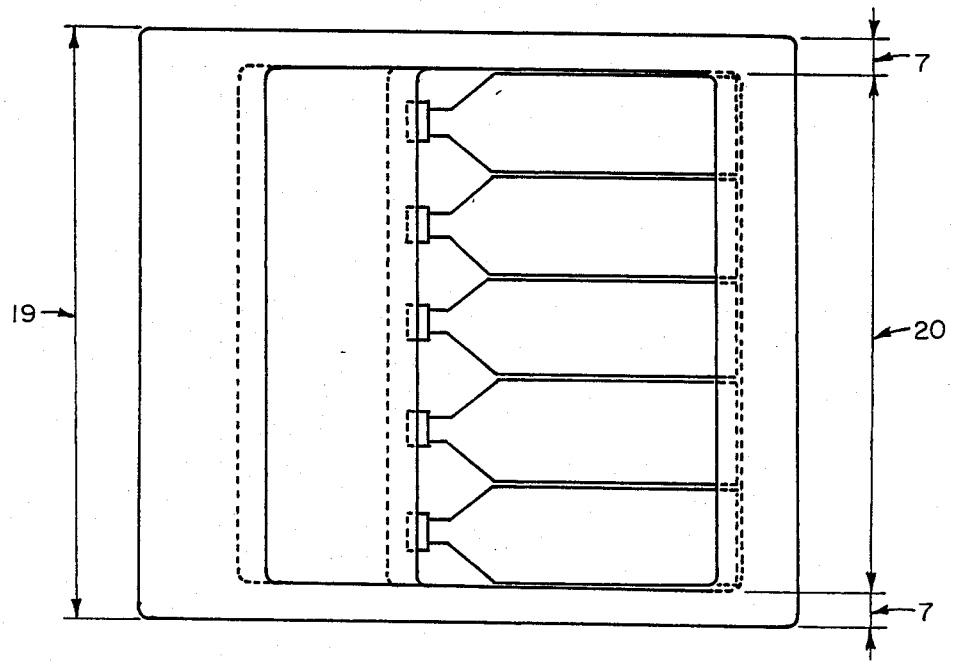
FIG. 1 is a plan view.

The first step in performing an oil change requires assembling new oil and paraphernalia to perform the work. This process will involve obtaining this container with desired number of quart oil containers 4 (internal dimensions 20 & 19 vary to accommodate this number) and transporting them in the container to the oil change location. This is greatly facilitated by a finger slot 10, of sufficient depth 18, allowing adequate grasp for comfortable carrying. After transportation to the oil change location, this product is either stored or used immediately. While in the container, the quart oil containers 4 are maintained in a position that precludes leakage outsidethe confines of the container. A rounded end 8 on the container prevents storage in an inverted position and is blended into the finger slot 10 to provide an easy grasping distance 17.

When the user is prepared to perform the oil change, the new units of oil 4 are removed from the container by sliding them in the direction of their caps and rotating them within clearances provided by 12, 14 & 16, thus freeing them from confining projection 11. Dimensions of projections and clearances will vary to accommodate quart oil containers (by various manufacturers). The "snap-in" drain port seal plug 5 (by various manufacturers) is then placed where it can be easily located. The depth 1 of the container allows it to be placed under the vehicle oil pan. This depth 1 can vary to accommodate various vehicle clearance requirements.

The engine crankcase drain plug is removed and stored for future reinstallation. At this point, the used crankcase oil flows into a depression in the external surface of the container which is sloped 6 to allow draining of this used oil into a drain port to be later plugged 5.

The external dimensions 2 & 19 of the container are such that they provide for containment of the entire volume of used oil from the engine lubrication system. After the oil ceases to drain from the crankcase and any other used quantities of oil associated with the oil change have been received by the container, the "snap-in" drain port seal plug 5 is placed in the drain port and seals the used oil within the interior of the container. At this point, the container may be cleanly removed from beneath the oil pan to facilitate placement of the crankcase drain plug without any chance of spillage. At this point, the replacement of a new oil filter is optional; however, when a determination is made and action is complete, the new oil in the containers 4 may be placed in the engine oil fill spout.

The stage of the oil change involving the engine now being complete requires attention to disposal of empty oil containers and used oil. The empty oil containers may be replaced and secured in the depression within the external surface of the container by reversing the process used to remove them. At this point, the container may be stored or transported to another point (e.g., disposal or recycle point) without spillage of either empty oil containers or used oil. The dimensions 7, 9 & 13 of the container are such that intentional or inadvertent transportation or storage in any position will maintain the volume of used oil without any possibility of spillage. This is by virtue of the volumes formed by the dimensions 7, 9 & 13 and sealable features of the "snap-in" drain port seal plug 5. These containers may be stacked for storage, disposal or recycling by virtue of their resistance to crushing created by the material thickness 15, double walls and the use of internal and external corners and edges 3 which eliminate stress points.

We claim:

1. A one-piece, semi-rigid self-supporting container which includes a bottom wall and surrounding side walls, said bottom and side walls being hollow, said container having a depression formed by the upper surface of said bottom wall and the interior surfaces of said side walls, said depression being configured to provide confinement for at least one smaller container, said depression having projections formed by said interior surfaces, said projections overlying said bottom wall and dimensioned to engagingly confine said at least one smaller container beneath said projections and within said depression, but allowing manipulative disengagement of said at least one smaller container therefrom, said depression being sloped toward a sealable hole therein, said hole accessing the hollow interior of the one-piece container.

* * * * *